US005535596A

United States Patent [19]

Todack

[11] Patent Number: 5,535,596

[45] Date of Patent: Jul. 16, 1996

[54] REFRIGERANT RECLAMATION AND PURIFICATION APPARATUS AND METHOD

[76] Inventor: James J. Todack, 2827 Carmel Woods Dr., Seabrook, Tex. 77586

[21] Appl. No.: 509,349

[22] Filed: Jul. 31, 1995

[51] Int. Cl.[6] ..... F25B 47/00

[52] U.S. Cl. ..... 62/85; 62/475; 62/292; 62/149; 62/195

[58] Field of Search ..... 62/77, 85, 149, 62/195, 475, 292, 470

[56] References Cited

U.S. PATENT DOCUMENTS

| | | | |
|---|---|---|---|
| 4,809,520 | 3/1989 | Manz et al. | 62/292 |
| 5,022,230 | 6/1991 | Todack | 62/77 |
| 5,172,562 | 12/1992 | Manz et al. | 62/149 |
| 5,363,662 | 11/1994 | Todack | 62/85 |

*Primary Examiner*—John M. Sollecito
*Attorney, Agent, or Firm*—Kenneth A. Roddy

[57] ABSTRACT

A portable refrigerant reclamation and purification apparatus removes moisture, oil, solid particulates, non-condensables, acid and other contaminants from refrigerant. Contaminated refrigerant is introduced into a separation chamber and vaporized as it passes over heat exchanger coils. During vaporization the bulk of contaminants are separated from the refrigerant and fall into a sump and the vapors are redirected 180° to an upward flow separating the contaminants from the refrigerant vapors. The vapors are drawn out of the chamber through demisting screens which strip remaining contaminants from the vapors and pass through a suction accumulator to either a compressor. The compressed gases are passed through an oil separator. and then either through the heat exchangers in the separation chamber to vaporize incoming liquid refrigerant, or to a condenser coil and then passed through a sub-cooling coil in the chamber over which the vapors drawn from the chamber pass, to lower the temperature of the refrigerant in the sub-cooling coil. The sub-cooled liquid refrigerant passes through a receiver where non-condensables are separated and purged from the system and the condensed liquid refrigerant is then passed through filters.

24 Claims, 3 Drawing Sheets

10
29
15
24
23A
34A
70
69
16
18
33A
34B
63
64
17
35
65
34C
23B
33B
34D
19
66
38
37
FROM
COND. 32
34E
67
40
TO
RECEIVER 41
34F
33C
23C
20
68
35
36
35
28
21
30
31

26
FROM OIL
SEPARATOR
82
TO INLET
VALVE 6
122
27
120
121
117
119
22
118
116
113
112
111
110
25
108
109
114
TO
WASTE
107
115
124
123
TO WASTE
FROM OTHER REFRIGERATION SYSTEM VACUUM

REFRIGERANT RECLAMATION AND PURIFICATION APPARATUS AND METHOD

FIELD OF THE INVENTION

This invention relates generally to refrigerant reclamation and purification systems, and more particularly to a self-contained refrigerant reclamation and purification apparatus and method for removing moisture, oil, solid particulates, non-condensables, acid and other impurities and contaminants from CFC's, HCFC's, HFC's and refrigerant blends and reclaiming the refrigerant.

BRIEF DESCRIPTION OF THE PRIOR ART

In the past, venting of refrigerants from refrigeration systems to the atmosphere was an expedient and economical method of removing contaminated refrigerants to permit repairs and allow the equipment to be returned to full production as quickly as possible. Scientific research has concluded that venting of chloroflourocarbon (CFC) and related refrigerants to the atmosphere has led to the depletion of the stratospheric ozone layer. In view of these findings, various taxes and legislative restrictions have been imposed to limit the production, use, and discourage discharging of such refrigerants. Alternative refrigerants, such as hydroflourocarbon (HFC) and hydrochloroflourocarbon (HCFC) may be used in place of CFC, but they are more costly and their usage in present equipment is not compatible in all cases. The above noted problems have necessitated the recovery, recycling, and reuse of CFC and HCFC types of refrigerants.

My previous patents, U.S. Pat. No. 5,022,230 issued Jun. 11, 1991 and U.S. Pat. No. 5,363,662 issued Nov. 15, 1994 disclose apparatus and methods for reclaiming a refrigerant which utilize a flooded distillation chamber to maintain the refrigerant at a low temperature during the distillation process. Although effectively cleaning the refrigerant by separating the contaminants from the refrigerant using a low temperature distillation process, which essentially freezes the moisture entrained in the refrigerant, the two systems of the previous patents require a reservoir of liquid refrigerant to be maintained in the distiller sump to achieve the desired temperature to effectuate the systems reclamation processing ability. The method taught in these previous patents is self limiting because, working with the lower temperature range causes the volume rate of distillation vapors to decrease, therefore slowing down total volume output of the system.

The present invention is a significant improvement over the prior art in general and these patents in particular, in that in the present invention, all refrigerant is vaporized in the separation chamber, prior to reaching the contaminate sump, except for a residual amount which is entrained in the contaminates and there is no low temperature maintenance requirement to effectuate the distillation/reclamation process.

The present invention is distinguished over the prior art in general, and these patents in particular by a portable refrigerant reclamation and purification apparatus and method which removes moisture, oil, solid particulates, non-condensables, acid and other impurities and contaminants from CFC's, HCFC's, HFC's and refrigerant blends and reclaims the refrigerant using cross heat exchange abd velocity change. Contaminated refrigerant is introduced through a spray nozzle into a separation chamber and vaporized as it passes over a series of heat exchanger coils. During vaporization the bulk of contaminants are separated from the refrigerant and fall into a sump and the vapors are redirected 180° to an upward flow separating the contaminants from the refrigerant vapors. The vapors are drawn out of the chamber through de-misting screens which strip remaining contaminants from the vapors and are passed through a suction accumulator to either a compressor or a vacuum pump where the gases are compressed. The compressed gases are passed through an oil separator to remove oil and then passed either through the heat exchangers in the separation chamber where their heat is used to vaporize incoming liquid refrigerant and residual refrigerant from waste contaminants in the sump, or to a condenser coil where they are condensed to liquid and passed through a sub-cooling coil in the chamber over which the vapors being drawn from the chamber pass to lower the temperature of the refrigerant in the sub-cooling coil. The sub-cooled liquid refrigerant passes through a receiver where non-condensables are purged from the system and the condensed liquid is then passed through a series of filters rendering it suitable for reuse.

SUMMARY OF THE INVENTION

It is therefore an object of the present invention to provide a highly efficient self-contained portable refrigerant reclamation and purification apparatus and method for removing moisture, oil, solid particulates, non-condensables, acid and other impurities and contaminants from CFC's, HCFC's, HFC's and refrigerant blends and reclaiming the refrigerant.

It is another object of this invention to provide an apparatus for reclaiming and purifying refrigerants which may be easily transported from one location to another, and may be connected to either a container containing contaminated refrigerant or to an operating industrial-sized refrigeration system for reclaiming the refrigerant without requiring the customer to shut down the operating refrigeration system.

Another object of this invention is to provide a method and apparatus for reclaiming and purifying refrigerants which utilizes a novel separation chamber in cross heat exchange with a condenser whereby the flow of the refrigerant vapors are used to assist in the separation of certain contaminants.

Another object of this invention is to provide a method and apparatus for reclaiming and purifying refrigerants which produces a valuable ecological function by purifying large volumes of used or contaminated refrigerants and CFCs and allows them to be reused in lieu of venting them to the atmosphere.

Another object of this invention is to provide a method and apparatus for bulk reclamation and purification of contaminated CFCs, HCFCs, HFCs and refrigerant blends which will meet ARI 700 purification standards.

Another object of this invention is to provide a method and apparatus for reclaiming and purifying refrigerants which does not require maintaining a liquid refrigerant at a low temperature in the sump of the separation chamber to effectuate reclamation processing ability.

Another object of this invention is to provide a method and apparatus for reclaiming and purifying refrigerants wherein the liquid refrigerant is substantially vaporized in the separation chamber before reaching the reservoir sump, thereby increasing the volume rate of distillation vapors and increasing the processing speed and total volume output.

Another object of this invention is to provide a method and apparatus for reclaiming and purifying refrigerants wherein the bulk of contaminants are separated from liquid refrigerant during vaporization and changing the direction of the vapors to increase the efficiency of separating high-boiling contaminants from the refrigerant vapors.

Another object of this invention is to provide a method and apparatus for reclaiming and purifying refrigerants which will strip residual refrigerant from accumulated waste contaminants by introducing hot discharge gas into the contaminants to effectively vaporize the residual entrained refrigerant.

Another object of this invention is to provide a method and apparatus for reclaiming and purifying refrigerants which also allows the filtration media used in the filtering units to be evacuated, dehydrated and re-generated.

A further object of this invention is to provide a method and apparatus for reclaiming and purifying refrigerants which can process either high-pressure or low-pressure refrigerants without modification of the apparatus.

A still further object of this invention is to provide an apparatus for reclaiming and purifying refrigerants which is simple in construction, economical to manufacture, and reliable in operation.

Other objects of the invention will become apparent from time to time throughout the specification and claims as hereinafter related.

The above noted objects and other objects of the invention are accomplished by a portable refrigerant reclamation and purification apparatus and method which removes moisture, oil, solid particulates, non-condensables, acid and other impurities and contaminants from CFC's, HCFC's, HFC's and refrigerant blends and reclaims the refrigerant. Contaminated refrigerant is introduced through a spray nozzle into a separation chamber and vaporized as it passes over a series of heat exchanger coils. During vaporization the bulk of contaminants are separated from the refrigerant and fall into a sump and the vapors are redirected 180° to an upward flow separating the contaminants from the refrigerant vapors. The vapors are drawn out of the chamber through de-misting screens which strip remaining contaminants from the vapors and are passed through a suction accumulator to either a compressor or a vacuum pump where the gases are compressed. The compressed gases are passed through an oil separator to remove oil and then passed either through the heat exchangers in the separation chamber where their heat is used to vaporize incoming liquid refrigerant and residual refrigerant from waste contaminants in the sump, or to a condenser coil where they are condensed to liquid and passed through a sub-cooling coil in the chamber over which the vapors being drawn from the chamber pass to lower the temperature of the refrigerant in the sub-cooling coil. The sub-cooled liquid refrigerant passes through a receiver where non-condensables are purged from the system and the condensed liquid is then passed through a series of filters rendering it suitable for reuse.

DESCRIPTION OF THE PREFERRED EMBODIMENT

Figure 1:
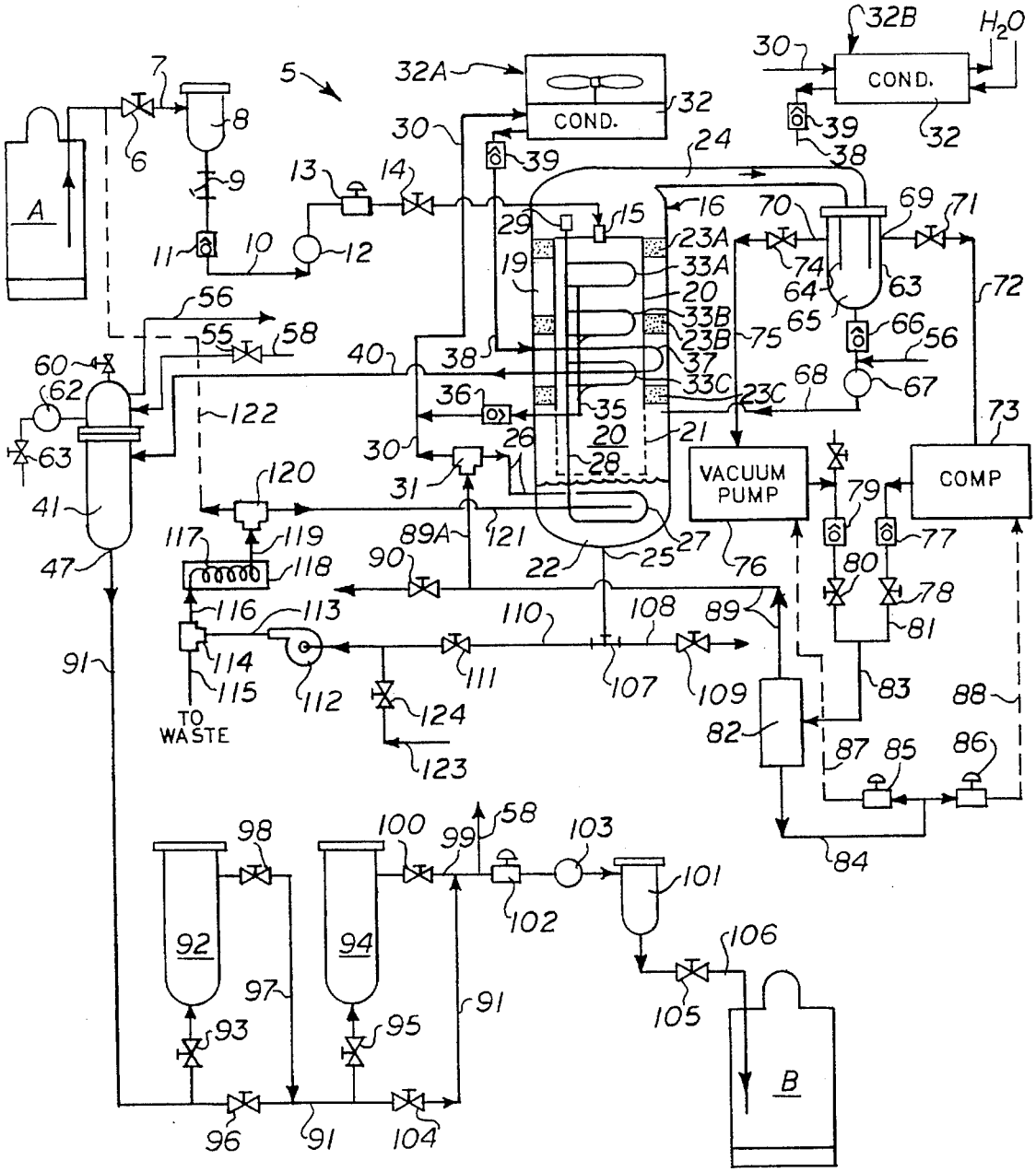
FIG. 1 is a schematic diagram of a refrigerant reclamation and purification system in accordance with a preferred embodiment of the invention.

Referring to the drawings by numerals of reference, there is shown schematically in FIG. 1, the refrigerant reclamation and purification apparatus 5 in accordance with a preferred embodiment of the present invention. The apparatus of the present invention may be assembled on a skid or trailer that may be easily transported from one refrigeration system to another. In operation, the apparatus may be connected to a container "A" containing contaminated refrigerant or, as described hereinafter, to an operating industrial-sized refrigeration system, such as a centrifugal chiller (not shown) for reclaiming the refrigerant. In the latter arrangement, the present reclamation process strips the refrigerant of moisture, acid, solid particles as well as excessive oil entrained in the liquid refrigerant and returns the refurbished refrigerant back to the operating chiller, thus eliminating the requirement for the customer to shut down the chiller when refrigerant cleaning is desired.

The apparatus 5 of the present invention comprises a refrigerant inlet isolation valve 6 connected by conduit 7 to a filter 8 containing filtering media and having a strainer 9 at the outlet thereof. The strainer 9 is connected by conduit 10 to a distributor nozzle 15 at the top of the inner chamber 20 of a separation chamber 16 (described in detail below) for conducting liquid thereto. A check valve 11 a sight glass 12, a solenoid valve 13, and a flow control valve 14 are connected in the conduit 10 between the strainer 9 and the distributor nozzle 15.

Figure 2:
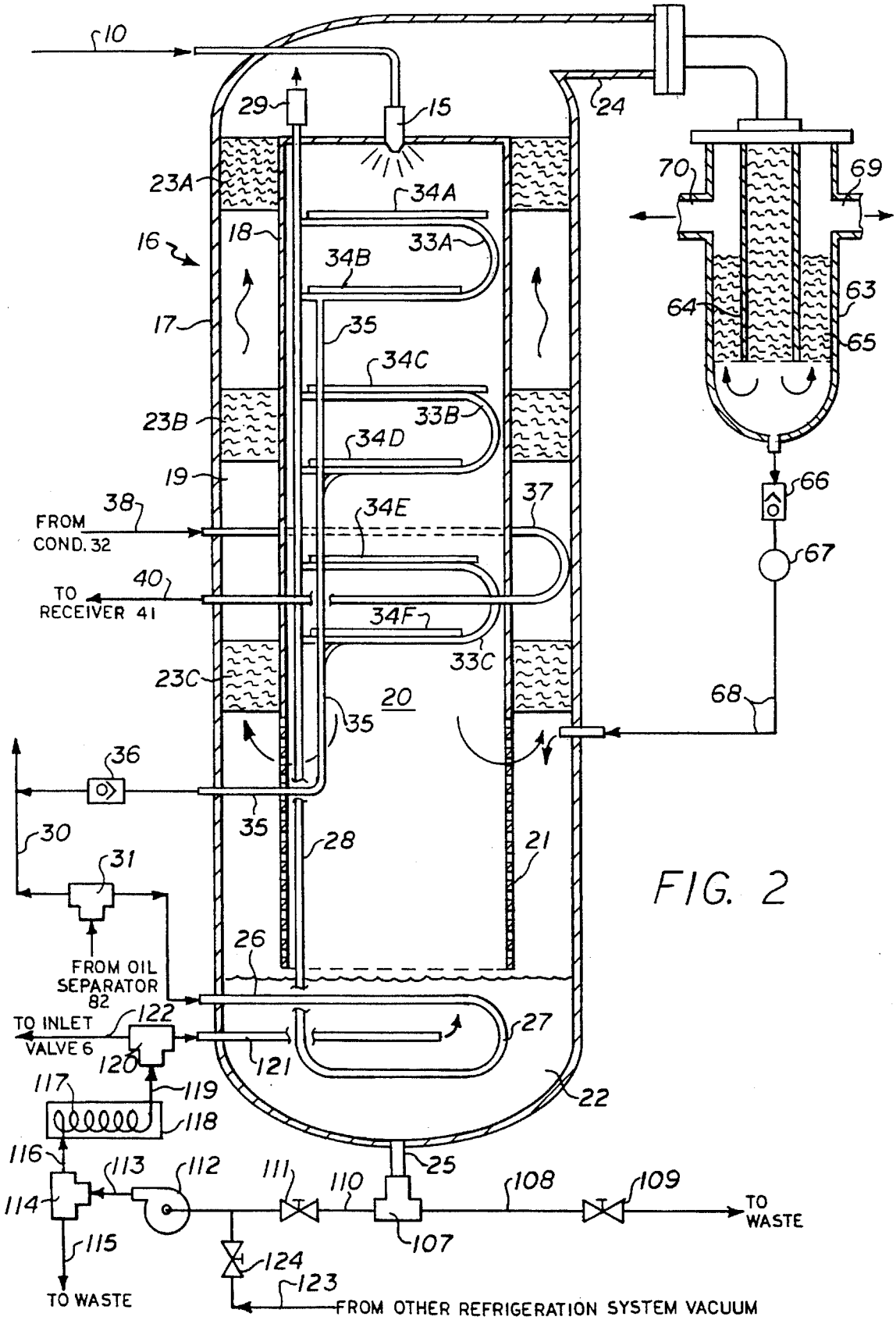
FIG. 2 is a schematic diagram of the interior of the separation chamber which utilizes target baffling and cross heat exchange to produce vaporization of liquid refrigerant droplets, and showing apparatus connected at the lower portion of the chamber for removing waste contaminates and removing residual refrigerant from the contaminate waste product.

Referring additionally to FIG. 2, the separation chamber 16 is shown in greater detail. An outer housing 17 surrounds an inner housing 18 defining an annular outer chamber 19 surrounding an inner chamber 20. A tubular perforated screen 21 extends from the bottom end of the inner housing 18. The rounded bottom end of the outer chamber 19 serves as a contaminate waste product sump 22. A plurality of oil-mist eliminators or de-mister screen pads 23A, 23B, and 23C, are disposed in the annular outer chamber 19 between the exterior of the side wall of the inner housing 18 and the interior of the side wall of the outer housing 17 in vertically spaced relation. A suction conduit 24 is connected at the upper portion of the outer housing 17 in fluid communication with the annular outer chamber 19. The outer housing 17 is provided with a drain outlet 25 in its rounded bottom end.

A conduit 26 extends inwardly through the side wall of the outer housing and passes horizontally through the waste product sump 22 and then curves to form an internal sump stripper coil 27 and has a vertical riser 28 which extends upwardly through the inner chamber 20 adjacent the interior of the side wall of the inner housing 18. A safety relief valve 29 is connected at the upper end of the vertical riser 28. The outer end of the conduit 26 is connected to a conduit 30 through a two-way hand operated flow diverter valve 31.

The conduit 30 is connected in fluid communication to the inlet of a condensing coil 32 (FIG. 1) which may be either air cooled 32A or water cooled 32B.

A plurality of horizontal heat exchanger coils 33A, 33B, and 33C having their ends connected in fluid communication to the vertical riser 28 are disposed within the inner chamber 20 in vertically spaced relation beneath the distributor nozzle 15. The horizontal portions of the heat exchanger coils 33A, 33B, and 33C each have a perforated screen or baffle plate 34A, 34B, 34C, 34D, 34E, and 34F attached to their upward facing exterior surfaces which break up the refrigerant and distribute it as droplets onto the heat exchangers below the upper screens. A conduit 35 is connected to the lower leg of each tube or coil 33A, 33B and 33C and extends vertically downward to the lower portion of the inner chamber 20 and outwardly through the side walls of the inner and outer housings 18 and 17 and is joined after passing through a check valve 36 in fluid communication with the conduit 30 above the flow diverter valve 31. As explained hereinafter, the flow diverter valve 31 will direct hot discharged gas either into conduit 26 or 30 depending upon whether an internal or external condenser is selected.

Figure 3:
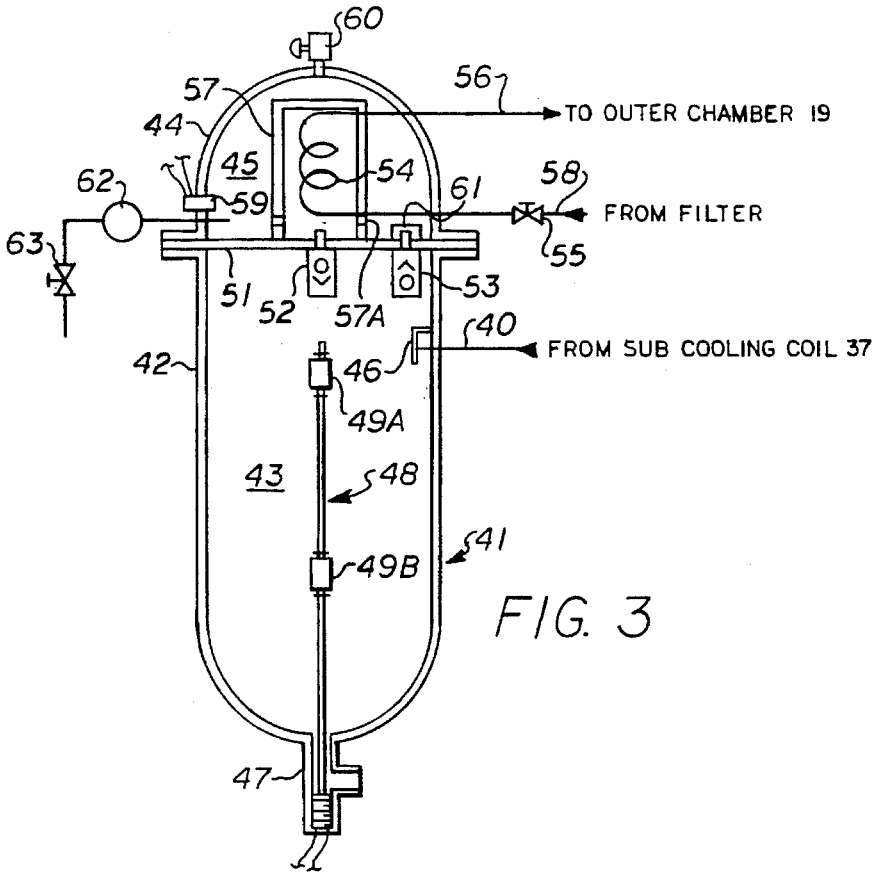
FIG. 3 is a cross section of the receiver/purge apparatus depicting schematically a flow control float means in the receiver section and a non-condensable separation means utilizing a refrigerated coil in the purge section to separate non-condensables from the refrigerant vapors.

A horizontal liquid refrigerant sub-cooling coil 37 is disposed in the annular outer chamber 19 between the side walls of the inner and outer housings 18 and 17 above the sump 22 and its ends extend outwardly through the side wall of the outer chamber housing 17. A check valve 39 is connected to the outlet of the condensing coil 32 and conduit 38 is connected at one end to the check valve 39 and its other end is connected to the inlet end of the liquid refrigerant sub-cooling coil 37. The outlet end of the liquid refrigerant sub-cooling coil 37 is joined by conduit 40 to a receiver 41 (FIGS. 1 and 3, described hereinafter).

A suction accumulator 63 is connected to the outer end of the suction conduit 24 of the separation chamber 16. As shown in FIG. 2, a tubular guide cylinder 64 is disposed in the interior of the accumulator 63 and the interior of the accumulator is filled with coalescing filter material 65. The guide cylinder 64 directs gases downward to the rounded bottom portion of the accumulator 63. The bottom of the accumulator 63 is joined through a check valve 66, sight glass 67, and conduit 68 to the interior of the outer chamber 19 just below the lowermost de-mister screen pad 23C. A high pressure outlet 69 and a low pressure outlet 70 are provided at the upper portion of the accumulator 63.

Referring again to FIG. 1, the high pressure outlet 69 of accumulator 63 is connected through isolation valve 71 and conduit 72 to a high pressure reciprocating open-drive type compressor 73. The low pressure outlet 70 of accumulator 63 is connected through isolation valve 74 and conduit 75 to a vacuum pump 76. A check valve 77 and isolation valve 78 are connected to the discharge of the compressor 73. A check valve 79 and isolation valve 80 are connected to the discharge of the vacuum pump 76 and the isolation valves 78 and 80 are joined by a common header 81.

An oil separator 82 is connected by conduit 83 to the common header 81 between the isolation valves 78 and 80. An oil return conduit 84 extends from the outlet of the oil separator 82 and is connected between two solenoid valves 85 and 86. The solenoid valve 85 is connected by conduit 87 to the oil sump of the vacuum pump 76 and the solenoid valve 86 is connected by conduit 88 to the oil sump of compressor 73. A gas discharge conduit 89 extends from the oil separator 82 and has an auxiliary discharge valve 90 at its outer end. A conduit 89A having one end connected with the conduit 89 between the oil separator 82 and discharge valve 90 joins the oil separator 82 to the two-way hand operated flow diverter valve 31 (described above).

Referring now additionally to FIG. 3, the receiver 41 is shown in greater detail. The receiver has a lower housing 42 defining a lower chamber 43 and an upper housing 44 defining a purge chamber 45. A target baffle plate 46 is disposed on the interior side wall of the lower chamber 43 of the receiver 41 adjacent the end of inlet conduit 40. The receiver 41 has an outlet 47 at its bottom end.

A commercially available float level reed switch valve control mechanism 48 is disposed in the interior of the lower chamber 43 and controls the liquid feed through the outlet 47. The control mechanism 48 has an upper reed switch float 49A and a lower reed switch float 49B slidably mounted on a rod 50 secured at the bottom of the chamber. When the switches of both floats are closed, an electrical circuit is completed to open the solenoid valve 102 and liquid leaves the chamber and continues until both switches open. The lower chamber 43 and purge chamber 45 are separated by a plate 51 and connected in fluid communication by a pair of check valves 52 and 53.

A cooling coil 54 is disposed in the purge chamber 45 and receives liquid refrigerant at one end through expansion valve 55 and conduit 58 joined to conduit 99 between isolation valve 100 and solenoid valve 102. The outlet of the coil 54 is connected by conduit 56 to the interior of the outer chamber 19 of the separation chamber 16 through sight glass 67 and conduit 68. The coil 54 is surrounded by a hollow cylindrical guide chamber 57 having a closed top end and vent holes 57A at its lower end. An exhaust valve 60 is connected to the top end of the purge chamber 45 in fluid communication with the interior of the purge chamber. The expansion valve 55 meters liquid refrigerant as it passes into the coil 54 creating a refrigerated condenser and conduit 56 returns the vapors from the coil 54 to the interior of the outer chamber 19 of the separation chamber 16 for re-processing. Check valve 52 allows non-condensable gases to pass into purge chamber 45 where they are directed across the coil 54. Non-condensables and refrigerant pass upward contacting the coil 54 where the refrigerant is condensed to a liquid and the remaining non-condensables pass through the collect in the chamber 75 for future venting through exhaust valve 60.

A weir 61 is disposed over the check valve 53 such that liquid refrigerant in the lower portion of the purge chamber 45 must exit through the weir. The weir 61 prevents water, which has been condensed from the refrigerant, from reentering the lower chamber 43 and check valve 53 prevents reverse flow of liquid back into the purge chamber 45. A sight glass 62 and drain valve 63 are disposed on the exterior of the purge chamber on fluid communication with the interior of the chamber. The drain valve 63 is used to remove any free water accumulation in purge chamber 45 that may be observed through sight glass 62.

A commercially available electronic refractory liquid level switch 59 is secured in the purge chamber 45. When the liquid level in the purge chamber 45 drops below a designated level, the switch 59 closes and completes an electrical circuit to actuate the solenoid vent valve 60.

Referring again to FIG. 1, the outlet 47 of the receiver 41 is connected by a conduit 91 to the inlet of a first filter unit 92 through an isolation valve 93 and to a second filter unit 94 through an isolation valve 95. The filter units 92 and 94 are filled with molecular sieve filtration media. An isolation valve 96 is disposed in the conduit 91 between the valves 93 and 95. A conduit 97 is connected at one end into the conduit 91 between the valves 95 and 96 and is connected at its other end to the upper portion of the first filter unit 92 through an isolation valve 98. One end of a conduit 99 is connected to the upper portion of the second filter 94 through an isolation valve 100 and its other end is connected to a third filter 101 through a solenoid valve 102 and sight glass 103. The end of the conduit 91 is joined into the conduit 99 between the isolation valve D and the solenoid valve 102 through an isolation valve 104. The outlet of the third filter unit 101 is connected through an outlet valve 105 and conduit 106 to a second container "B". As explained hereinafter, an arrangement is provided for dehydrating and re-generating the filtration medium used in the filter units 92 and 94.

Referring now to FIG. 2, the lower portion of the separation chamber 16 is shown connected with a system of apparatus which is used to carry out the distillation process when required. As described above, the outer end of the conduit 26 is joined with a conduit 30 through a two-way hand operated flow diverter valve 31. When distillation is required, the hot discharge gases are directed via flow diverter valve 31 through conduit 26 into internal sump stripper coil 27, where the initial heat of compression is used to heat the waste product that will be separated from the initial inlet refrigerant stream. A tee fitting 107 is connected to the drain outlet 25 of the separation chamber waste sump 22. One end of the tee fitting 107 is connected by a conduit 108 and drain valve 109. The conduit 108 serves as a manual drain line which is used when the sump 22 requires complete draining.

The other end of the tee fitting 107 is connected through conduit 110 and isolation valve 111 to the suction end of a solution pump 112. The discharge end of the pump 112 is connected by conduit 113 to a two-way valve 114. The two-way valve 114 is connected to a waste container (not shown) by conduit 115 and is connected by conduit 116 to the internal coil 117 of a heat exchanger 118. The outlet of the coil 117 is connected by conduit 119 to a two-way valve 120. Conduit 121 is connected at one end to the two-way valve 120 and extends through the side wall of the outer chamber 19 and into the waste sump 22 at the lower end of the separation chamber 16. The coil 117 is submerged in a heated oil bath and assists sump heat exchanger stripper coil 27 in adding additional heat to the waste product in the sump 22.

Conduit 122 is connected at one end to the two-way valve 120 and its other end is joined back into the refrigerant inlet valve 6 (FIG. 1).

A conduit 123 is connected through an isolation valve 124 into the conduit 110 between the isolation valve 111 and the pump 112. The valve 124 and conduit 123 is used to connect the present system to an operating industrial sized refrigeration system such as a centrifugal chiller (not shown) to reclaim the refrigerant without the necessity of shutting down the chiller when refrigerant cleaning is desired (described hereinafter). Solution pump 112 adds additional suction pressure to the suction of the operating refrigeration system, thus enhancing the on-line refrigerant cleaning process.

Figure 4:
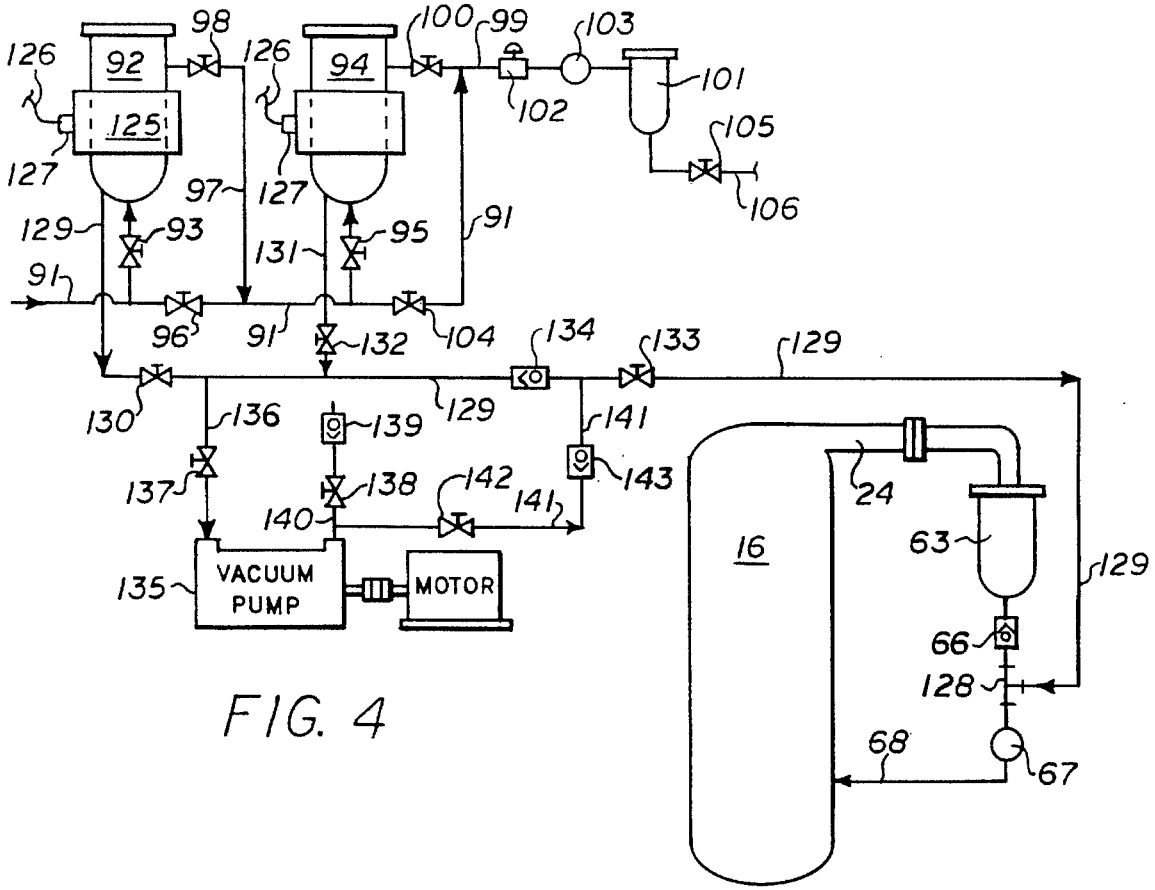
FIG. 4 is a schematic diagram illustrating a system of apparatus for dehydrating and re-generating the molecular sieve filtration media used in the filter units of the system.

Referring now to FIG. 4, there is shown, schematically, a system of apparatus for dehydrating and re-generating the molecular sieve filtration media used in the filter units 92 and 94. Thermostatically controlled electrical heating units 125, such as strap-on electrical heaters, are installed on the housings of the filter units 92 and 94 and connected to an electrical source (not shown) by electrical connectors 126. Each heater 125 is controlled by a thermostat 127. A tee fitting 128 is installed between the check valve 66 and sight glass 67 in the conduit 68 which connects the bottom of the suction accumulator 63 to the interior of the outer chamber 19 of the separator chamber 16. A conduit 129 is connected at one end to the tee fitting 128 and connected to the lower end of the first filter unit 92 through an isolation valve 130. A conduit 131 is connected at one end into the conduit 129 and at its other end to the lower portion of the second filter unit 94 through an isolation valve 132. An isolation valve 133 and check valve 134 are installed in the conduit 129 between the tee fitting 128 and the isolation valve 132.

The inlet of a vacuum pump 135 is connected to the conduit 129 between the isolation valve 130 and conduit 131 by conduit 136 and isolation valve 137. An isolation valve 138 and check valve 139 are connected to the discharge outlet of the vacuum pump 135 through a tee fitting 140. A conduit 141 is connected at one end to the tee fitting 140 at the pump discharge and its other end is joined through an isolation valve 142 and check valve 143 back into the conduit 129 between the isolation valve 133 and check valve 134.

OPERATION

Referring again to FIG. 1, contaminated refrigerant in container "A" enters through inlet isolation valve 6, passing through conduit 7, passing through filter 8, where the large solid particles are prevented from entering the remaining process piping. When the refrigerant leaves the filter 8 it will pass through strainer 9, check valve 11, through conduit 10 into sight glass 12, solenoid valve 13 and to the flow control valve 14. The flow control valve 14 meters the flow of liquid refrigerant through conduit 10 to the distributor nozzle 15 located at the top of the inner chamber 20 of the separation chamber 16. The annular outer chamber 19 of the separation chamber 16 surrounds the inner chamber and is in fluid communication with the suction ports of the compressor 73 and vacuum pump 76.

As the liquid refrigerant passes through the distributor nozzle 15 the liquid undergoes a reduction in pressure while being sprayed downward in an even pattern over the heat exchanger coils 33A–33C and baffle plates 34A–34F which are enclosed in the inner chamber 20. The perforated screens or baffle plates 34A–34F break up the refrigerant and distribute it as droplets onto the successive lower heat exchanger coils 33A–33C and baffle plates 34A–34F and provide a large heat transfer surface area and cause complete vaporization of the liquid refrigerant droplets, thus effectively separating the high boiling residues and other contaminates from the refrigerant vapors.

As the now vaporized gases reach the perforated screen 21 at the lower portion of the inner chamber 20, the vaporized gases pass through the screen and are abruptly re-directed 180° from a downward motion to an upward motion, and thereby causing substantially all of the non-volatile contaminates, such as oil, acid, free-water, and solid particles, to drop to the waste product sump 22 at the lower end of the separation chamber 16.

Continuing to follow the path of the now vaporized refrigerant gases, the vaporized refrigerant gases are now drawn upward through the annular outer chamber 19 between the side walls of the inner and outer housings 18 and 17. As these gases are drawn in the direction of the suction conduit 24 by the compressor 73 or vacuum pump 76, they will pass through the oil mist eliminators or de-mister screen pads 23A–23C, and across the refrigerant sub-cooling coil 37. The de-mister pads 23A–23C interrupt the gas path, causing any residue non-volatile mist to be stripped from the gas stream, thus substantially removing all the contaminates from the vapors leaving the separation chamber 16.

The liquid refrigerant sub-cooling coil 37 disposed in the path of the vaporized refrigerant gases contains the liquid refrigerant which is leaving the condenser coil 32 and the cold refrigerant gases being drawn through the de-mister pads and across the coil 37 reduces the temperature of the liquid refrigerant in the coil after it leaves condenser coil 32. The refrigerant vapors pass through suction conduit 24 and enter the chamber of the suction accumulator chamber 63. The vapors pass through coalescing filter material 65 and the guide cylinder 64 directs the gases downward to the rounded lower portion of the accumulator chamber. The gases then change direction 180° from a downward direction to an upward direction and rise to the upper portion of the suction accumulator 63 where two potential exits outlets 69 and 70 are available, depending upon whether the type of refrigerant that is being processed is high-pressure or low-pressure. Any accumulation of liquid refrigerant in the chamber of the suction accumulator 63 is drawn back into the separation chamber 16 through check valve 66, sight glass 67, and conduit 68 which are in fluid communication with the outer chamber 19 just below the lowermost de-mister screen pad 23C.

The high-pressure outlet 69 of the suction accumulator 63 is connected to the high-pressure reciprocating open drive type compressor 73 through conduit 72. The low-pressure outlet 70 is connected to the vacuum pump 76 through conduit 75. The isolation valves, 71, 74, 78, and 80 and check valves 77 and 79 prevent refrigerant gases from entering the compressing means (73 or 76) that is not being utilized.

At this point in time a selection of the type of refrigerant to be processed must be determined. If low-pressure refrigerant processing is desired, isolation valves 71 and 78 are closed and isolation valves 74 and 80 are opened, and the vacuum pump 76 will be in service and low-pressure refrigerant may be processed. If high-pressure refrigerant processing is desired, isolation valve 71 and 78 are opened and isolation valves 74 and 80 are closed and the high-pressure reciprocating compressor 73, is opened to the refrigerant circuit to permit processing of high-pressure refrigerant.

As the high-pressure or low-pressure refrigerant gas is discharged from either the vacuum pump 76 through check valve 79 and isolation valve 80 or from compressor 73 through check valve 77 and isolation valve 78, the refrigerant gas enters into the common header 81. The hot discharged refrigerant gas passes through conduit 83 into the oil separator 82 where the oil, picked up during the compression cycle, is removed from the refrigerant gas stream. This oil is returned either to the oil sump of the vacuum pump 76 through solenoid valve 85 or the oil sump of the compressor through solenoid valve 86.

The hot refrigerant gas which was separated from the oil is discharged from the oil separator 82 via conduit 89 and to the auxiliary discharge valve 90 though conduit 89 and to the two way hand operated flow diverter valve 31 via conduit 89A. At this point, a selection of either internal or external condenser processing is determined, thus directing the hot discharge gas either into conduit 26 or 30 via the two-way valve 31. When distillation is required, the hot discharge gases are directed through conduit 26 into the sump stripper coil 27, where the initial heat of compression is used to heat the waste product that will be separated from the initial inlet refrigerant stream. This discharge gas heat will cause the remaining refrigerant to be vaporized from the waste product, prior to it being removed from the waste product sump 22 of the separation chamber 16.

The discharge gas, passes through the sump heating coil 27. The refrigerant waste product in the sump 22 becomes heated, causing the refrigerant which is entrained in the waste to vaporize. To assist in this vaporization stripping process, the solution pump 112 and heat exchanger 118 are utilized. The solution pump 112 draws waste product from the waste sump drain 25 through conduit 110 and discharges the heated waste product through conduit 113 to the two-way valve 114. The two-way valve 114 directs the waste product either to a waste container (not shown) through conduit 115 or to the heat exchanger 118 through the conduit 116.

Conduit 116 directs the waste product into the coil 117 of the heat exchanger 118 which is submerged in a heated oil bath. The heat exchanger coil 117 picks up additional heat in the heat exchanger 118 and assists the sump heat exchanger stripper coil 27 by adding additional heat to the waste passing through the coil 117.

After the waste product has been heated by the heat exchanger coil 117, it flows through conduit 119 to the two-way valve 120 where it is directed either through conduit 121 or conduit 122 (conduit 122 will be discussed hereinafter).

Conduit 121 directs the heated waste product back into the waste sump 22 where it is exposed to the suction pressure in the separation chamber 16. The heat, in combination with the suction pressure inside the chamber 16 substantially vaporizes all the remaining refrigerant. The remaining waste material can be drained through conduit 110 by pump 112 when the two-way valve 114 is positioned to dump through conduit 115. Conduit 108 and valve 109 are used when the sump 22 requires complete draining.

As an additional feature to the reclamation process, the present system may be used to reclaim refrigerant from an operating industrial sized refrigeration system such as a centrifugal chiller. The reclamation process strips the refrigerant of moisture, acid, solid particles as well as excessive oil entrained in the liquid refrigerant and returns the refurbished refrigerant back to the operating chiller, thus eliminating the requirement for the customer to shut down the chiller when refrigerant cleaning is desired.

This process is accomplished by directing the incoming contaminated refrigerant from the customer's refrigeration system (which would normally enter through inlet valve 6), through conduit 123 and isolation valve 124 into conduit 110. Isolation valve 111 is closed to prevent any refrigerant waste from entering this liquid refrigerant stream. The liquid refrigerant enters the solution pump 112 through conduit 110 and is discharged through conduit 113 to the two-way valve 114. The two-way valve 114 is positioned to direct the flow of refrigerant to the heat exchanger 118 through conduit 116. As the liquid refrigerant passes through heat exchanger coil 117, the pressure and the temperature of the refrigerant is increased. The refrigerant then flows through conduit 119 to the two-way valve 120. The two-way valve 120 is positioned to direct the flow of refrigerant through conduit 122 to the conduit 7 at the inlet of the refrigerant inlet valve 6. Inlet valve 6 then introduces the refrigerant from the other system to the reclamation process as described above. The solution pump 112 adds additional suction pressure to the suction pressure of the other operating refrigeration system, thus enhancing the efficiency of the on-line refrigerant cleaning process.

Referring now to FIG. 2, the hot discharge gas leaving the heat exchange stripper coil 27 in the sump 22 flows upwardly through vertical riser 28 and is distributed through the heat exchanger coils 33A–33C having baffle plates 34A–34 on their upper surfaces. The relief valve 29 at the top of the riser 28 serves as a safety release to prevent over-pressurization.

The contaminate liquid refrigerant stream entering the separation chamber 16 through the distributor nozzle 15 vaporizes as it strikes the heated coils and baffle plates, thus distilling the liquid refrigerant while the hot discharge gas, passing through interior of the coils 33A–33C becomes subcooled, thus condensing these vapors into a liquid phase. The now condensed liquid falls downwardly through conduit 35 and passes through check valve 36 and into conduit 30, which is in fluid communication with the either air cooled 32A or water cooled 32B condensing coil 32 (FIG. 1). At this point the refrigerant gases will complete the condensing cycle and the liquid refrigerant will pass from the condensing coil 32 through conduit 38 and check valve 39 into the sub-cooler coil 37.

The sub-cooler coil 37 is positioned in the path of the cool refrigerant vapors exiting the separation chamber 16. The cooled refrigerant vapors leaving the chamber 16 extract heat from the liquid refrigerant passing through the sub-cooler 37, thus significantly reducing the temperature of the liquid refrigerant and enhancing the efficiency of the system by increasing filter media performance due to the ability of the filter media to absorb larger quantities of moisture when the temperature of the entering liquid passing through filters 92 and 94 is lowered.

Referring now to FIG. 3, the sub-cooled liquid refrigerant from the coil 37 is directed through conduit 40 into the chamber 43 of receiver 41. A portion of the refrigerant and non-condensable gases pass through check valve 52 into the purge chamber 45 and across the cooling coil 54 where the refrigerant condenses into a liquid phase and drops to the lower portion of the chamber. The non-condensable gases fill the guide cylinder, stopping the refrigerant from condensing and forcing the liquid level in the purge chamber to drop sufficient to activate the electronic float valve switch 59 to open the vent valve 60. Thus, the non-condensable gases are separated from the liquid refrigerant in the purge chamber 45 of the receiver 41. The liquid refrigerant in the lower portion of the purge chamber 45 passes through the check valve 53 into the lower chamber 43 and water which has been separated from the refrigerant is prevented from reentering the lower chamber by the weir 61. Drain valve 63 is used to remove any free water accumulation that may be observed through sight glass 62 from the purge chamber 45.

Expansion valve 55 is used to meter liquid refrigerant as it passes into the coil 54 to create a refrigerated condenser. Conduit 56 connected between the sight glass 66 and check valve 67 returns the vapors passing through the cooling coil 54 to chamber 13 through check valve 67 and conduit 68 for re-processing.

Referring again to FIG. 1, the liquid refrigerant which accumulates in receiver 41 now passes through the outlet 47 and conduit 91 to the inlet of filter units 92 and 94. When filtration is required the liquid refrigerant may be passed through filter units 92 and 94 by opening isolation valve 93 and closing isolation valve 96. The liquid refrigerant then enters filter unit 92 and exits through isolation valve 98 and conduit 97 back into conduit 91. With isolation valve 104 closed, the filtered refrigerant passes through open isolation valve 95 into filter unit 94. With isolation valve 100 open, the now twice filtered refrigerant passes through solenoid valve 102 and sight glass 103 and enters the filter unit 101. Filter unit 101 captures the filter media residues from the filter units 92 and 94. Exit valve 105 is opened to discharge the filtered and purified refrigerant through conduit 106 into container "B".

Another feature of the present apparatus and method is the re-generation of the molecular sieve filtration media used in the filter units 92 and 94. Referring now to FIG. 4, process for evacuation, dehydration and re-generating the molecular sieve filtration media in the filter units 92 and 94 will be described. The molecular sieve material reduces the moisture content of the liquid refrigerant to reclamation specification standards (moisture content of 10 ppm or less).

The regeneration process can be accomplished by isolating either one or both filter units 92 and 94. Liquid refrigerant flowing through the conduit 91 from the receiver 41 is redirected around the filter units 92 and 94 by opening isolation valves 96 and 104 and closing isolation valves 93, 98, 95, and 100, thus isolating the filter units 92 and 94. By opening isolation valves 130 and 132 and closing isolation valve 137, the liquid refrigerant contained in the filter units 92 and 94 will be drawn through the conduits 129 and 131, the check valve 134, the isolation valve 133, into the tee fitting 128, and through the sight glass 67 and conduit 68, into the outer chamber 19 of the separation chamber 16. Due to the lowered pressure in the separation chamber 16, when the reclamation process is in operation, substantially all the liquid and gas refrigerant in filter units 92 and 94 is drawn from the units and into the separation chamber 16 where it is reprocessed.

Upon evacuation of the filter units 92 and 94, isolation valves 137 and 142 are opened and vacuum pump 135 is turned on. The pump 135 preferably draws a vacuum in the range of about 7 mm to about 10 mm Hg. The remaining vapors in the filter units 92 and 94 are drawn through isolation valve 137 and into the suction side of the vacuum pump 135. The gases are discharged through the discharge side of the pump 135, through the now open isolation valve 142, through check valve 143, and reenters the conduit 129, and then passes through isolation valve 133, into the tee fitting 128, and through the sight glass 67 and conduit 68, into the outer chamber 19 of the separation chamber 16.

At a vacuum of approximately 25 inches Hg., the electric heating units 125 are manually activated to increase the temperature of the filter units 92 and 94 to approximately 200° F. This increase in temperature heats substantially all the molecular sieve media contained within the filter units 92 and 94.

The combination of the heat generated by the heating units 125 and the vacuum in the range of from about 7 mm to about 10 mm Hg. generated by the vacuum pump 135 will cause the moisture which has been absorbed within the molecular sieve media to vaporize and it can then be extracted as a gas. This is accomplished by closing isolation valves 142 and 133, thus venting the gases from the system through the now open isolation valve 138 and check valve 139.

The evacuation, dehydration, and re-generation process takes about 4 hours to accomplish the desired result, after which the filter units 92 and 94 may be returned to their intended function in the reclamation process.

While this invention has been described fully and completely with special emphasis upon a preferred embodiment, it should be understood that within the scope of the appended claims the invention may be practiced otherwise than as specifically described herein.

What is claimed is:

1. A refrigerant reclamation and purification apparatus comprising:

a separation vessel having a refrigerant inlet for admitting contaminated refrigerant into the vessel, first heat exchange means positioned in said vessel for vaporizing said contaminated refrigerant, second heat exchange means in said vessel positioned in heat exchange relation with the refrigerant vapors, a sump in a lower end of said vessel for receiving contaminate waste, and a vapor outlet;

compressor means having a suction inlet and a pressure outlet, said suction inlet connected with said vapor outlet of said vessel for lowering the pressure in said vessel and drawing refrigerant vapors from said vessel and compressing said refrigerant vapors;

oil removal means having an inlet connected with said vapor outlet of said compressor means for receiving a heated compressed refrigerant vapor from said compressor and removing oil therefrom, an oil return outlet connected with said compressor means for returning oil thereto, and a vapor outlet;

valve means having an inlet connected with said vapor outlet of said oil removal means, a first vapor outlet connected with the interior of said first heat exchange means in said vessel for conducting a heated compressed refrigerant vapor thereinto, and a second vapor outlet, said valve being selectively movable to divert a heated compressed refrigerant through said first or second outlet;

said heated compressed refrigerant vapor conducted through said first heat exchange means transferring heat to said said contaminated refrigerant waste to vaporize and distill said contaminated refrigerant and said heated compressed refrigerant being cooled by the heat transfer;

a condenser having an inlet connected with said second vapor outlet of said valve means for receiving heated compressed refrigerant vapors and cooling the heated compressed refrigerant vapor into condensated liquid refrigerant, and an outlet connected with the interior of said second heat exchange means for conducting the cooled condensated liquid refrigerant thereinto;

said refrigerant vapors being drawn from said vessel across said second heat exchange means further cooling said cooled condensated liquid refrigerant and gases being conducted through said second heat exchange means;

a non-condensable receiver/purge chamber having an inlet connected with the interior of said second heat exchange means for receiving cool condensated liquid and gases from said second heat exchange means, a cooling coil for condensing said gases to a liquid phase, vent means for venting non-condensed gases, and a liquid refrigerant outlet; and filter means having a housing with an inlet connected with said liquid refrigerant outlet for receiving cool non-condensable liquid refrigerant from said receiver/purge chamber and containing a filter medium for removing particulates, acid, impurities, and contaminants from said cool liquid refrigerant, and having an outlet for discharging the filtered and purified liquid refrigerant.

2. The apparatus according to claim 1 wherein said first heat exchange means has a portion disposed in said sump and said heated compressed refrigerant vapor conducted through said first heat exchange means transferring heat to said contaminate waste to vaporize residual refrigerants entrained in said contaminate waste in said sump.

3. The apparatus according to claim 1 further comprising oil-mist eliminator means positioned in said said separation vessel to allow passage therethrough of said refrigerant vapors being drawn from said vessel, said oil-mist eliminator means separating oil mist from the vapors passing therethrough.

4. The apparatus according to claim 1 wherein said separation vessel contains flow diverting means for conducting said admitted contaminated refrigerant in a first direction across said first heat exchange means for vaporizing said contaminated refrigerant and following vaporization diverting the refrigerant vapors to flow in a second direction across said second heat exchange means while allowing the contaminate waste to continue in said first direction into said sump, thereby separating a substantial amount of contaminants from said refrigerant vapors.

5. The apparatus according to claim 4 wherein said flow diverting means comprises an inner housing having a longitudinal side wall defining an inner chamber in fluid communication with said refrigerant inlet and an outer housing surrounding said inner chamber having a longitudinal side wall radially spaced from said inner chamber side wall defining an annular outer chamber in fluid communication with said vapor outlet; and said inner chamber side wall having an appertured portion spaced longitudinally from said first heat exchange means such that said refrigerant vapors will be drawn through said apertured portion following vaporization and diverted to flow in the second direction across said second heat exchange means by said compressor means.

6. The apparatus according to claim 5 wherein said first heat exchange means comprises a plurality of tubular coils positioned in said inner chamber in longitudinally spaced relation; and a plurality of baffle elements on an outer surface of said coils to engage said admitting contaminated refrigerant and cause it to form droplets which pass therethrough to engage succesive longitudinally spaced ones of said coils and baffle elements.

7. The apparatus according to claim 1 further comprising a suction accumulator having a vapor inlet connected with said vessel vapor outlet for receiving refrigerant vapors therefrom, a vapor outlet connected with compressor means suction inlet, and a liquid return outlet connected with the interior of said vessel; and said suction accumulator containing coalescing filter material for removing liquids from refrigerant vapors and flow diverting means for conducting the received refrigerant vapors through said coalescing filter material in a first direction and diverting the refrigerant vapors to flow through said coalescing material in a second direction toward said vapor outlet, and any accumulated liquid refrigerant in said suction accumulator being returned through said liquid outlet to the interior of said vessel for reprocessing.

8. The apparatus according to claim 7 wherein said suction accumulator has a low-pressure vapor outlet and a high-pressure vapor outlet; and said compressor means comprises a vacuum pump and a high-pressure compressor, said vacuum pump having a suction inlet connected through a first valve with said low-pressure vapor outlet and having a discharge outlet with a first check valve and a second valve connected in series to its discharge outlet, said high-pressure compressor having a suction inlet connected through a third valve with said high-pressure vapor outlet and having a discharge outlet with a second check valve and a fourth valve connected in series to its discharge outlet;

a header conduit having opposed ends connected to said second valve and said fourth valve and an outlet between said opposed ends connected in fluid communication to said oil removal means inlet;

said vacuum pump selectively placed in use for compressing low-pressure refrigerant vapors by opening said first and second valves to establish fluid communication therethrough and closing said third and fourth valves to prevent fluid communication through said high-pressure compressor; and said high-pressure compressor selectively placed in use for compressing high-pressure refrigerant vapors by opening said third and fourth valves to establish fluid communication therethrough and closing said first and second valves to prevent fluid communication through said vacuum pump; and said first and second check valves preventing refrigerant gases from entering the compressing means that is not being utilized.

9. The apparatus according to claim 1 further comprising:

a sump drain outlet on said vessel in fluid communication with said sump;

a sump drain valve connected with said sump drain outlet;

a pump having a suction inlet connected with said sump drain valve for receiving contaminate waste from said sump and having a discharge outlet;

heating means having an inlet connected to said pump discharge outlet for receiving compressed contaminate waste from said pump and having an outlet, said heating means heating said compressed contaminate waste;

conduit means having a first end connected with said heating means outlet and a second end disposed in said sump of said vessel, and said heated compressed contaminate waste conducted through said conduit means back into said sump after being heated to add additional heat to said said contaminate waste in said sump and facilitate vaporization of residual refrigerant.

10. The apparatus according to claim 9 wherein said heating means comprises a hot oil heater having a coil submerged in a heated oil bath, said pump discharge outlet and said conduit first end connected in fluid communication with the interior of said coil for conducting said compressed contaminate waste therethrough.

11. The apparatus according to claim 9 further comprising:

inlet means having a first end adapted for connection in fluid communication to an outlet on the low pressure side of a refrigeration system containing contaminated refrigerant liquid and a second end connected in fluid communication between said sump drain valve and said pump suction inlet for receiving condensed contaminated refrigerant liquid from said refrigeration system and conducting it to said heating means inlet;

second conduit means having a first end connected with said heating means outlet and a second end connected in fluid communication with the refrigerant inlet of said separation vessel for admitting said contaminated refrigerant into said vessel; and third conduit means having one end connected in fluid communication with said filter means outlet and a second end adapted for connection in fluid communication to an inlet on the high pressure side of said refrigeration system from which said contaminated refrigerant liquid was withdrawn for discharging the filtered and purified liquid refrigerant back into said refrigeration system after processing.

12. The apparatus according to claim 1 wherein:

said refrigerant inlet means of said separation vessel is adapted for connection in fluid communication to an outlet on the low pressure side of a refrigeration system containing contaminated refrigerant liquid for admitting contaminated refrigerant liquid from said refrigeration system into said vessel; and said filter means outlet is adapted for connection in fluid communication to an inlet on the high pressure side of said refrigeration system from which said contaminated refrigerant liquid was withdrawn for discharging the filtered and purified liquid refrigerant back into said refrigeration system after processing.

13. The apparatus according to claim 1 further comprising;

a thermostatically controlled heater connected to said filter means housing for supplying heat to said filter medium contained therein at a temperature sufficient to vaporize moisture which has been absorbed in said filter medium; and a filter vacuum pump having a suction inlet connected in fluid communication with the interior of said filter means housing for drawing the moisture vapors from the interior of said filter means housing and having a discharge outlet connected with the interior of said vessel for conducting said moisture vapors into the atmosphere; whereby the combination of heat and vacuum will extract a sufficient amount of moisture from said filter medium to substantially dehydrate and regenerate the filter medium.

14. A method for reclaiming and purifying a refrigerant comprising the steps of:

providing a separation vessel having compressor means connected therewith means to lower the pressure in said vessel and draw refrigerant vapors from said vessel;

introducing a contaminated refrigerant into said vessel;

conducting said contaminated refrigerant across a first heat exchange means in said vessel to vaporize said contaminated refrigerant, collecting contaminate waste in a sump, and drawing the refrigerant vapors across second heat exchange means in said vessel and into the suction inlet of said compressor means;

compressing said refrigerant vapors to increase the temperature;

removing the oil from said heated compressed refrigerant vapors, and returning the removed oil to said compressor means;

selectively diverting said heated compressed refrigerant vapors either into the interior of said first heat exchange means or into a condenser having an outlet connected with the interior of said second heat exchange means;

said heated compressed refrigerant vapor when diverted into the interior of said first heat exchange means transferring heat to said contaminated refrigerant in said vessel to vaporize and distill said contaminated refrigerant and said heated compressed refrigerant being cooled by the heat transfer and thereafter being conducted through said condenser into the interior of said second heat exchange means;

said heated compressed refrigerant vapor when diverted to said condenser being cooled thereby into condensated liquid refrigerant and gases and conducted through the interior of said second heat exchange means and being further cooled by said refrigerant vapors being drawn from said vessel across said second heat exchange means;

separating non-condensables from refrigerant gases and non-condensable gases from said cool condensated liquid after it passes from the interior of said second heat exchange means, and venting said non-condensable gases; and thereafter conducting said cool liquid refrigerant through filter means to remove particulates, acid, moisture, and contaminants therefrom to render the filtered and purified liquid refrigerant suitable for reuse.

15. The method according to claim 14 including the step of providing a portion of said first heat exchange means in said sump and conducting said heated compressed refrigerant vapor through said first heat exchange means to transfer heat to said contaminate waste to vaporize residual refrigerants entrained in said contaminate waste in said sump.

16. The method according to claim 14 wherein the step of drawing the refrigerant vapors across second heat exchange means in said vessel and into the suction inlet of said compressor means includes drawing said refrigerant vapors through oil-mist eliminator means to filter oil and moisture from the refrigerant vapors drawn therethrough.

17. The method according to claim 14 wherein said steps of conducting said contaminated refrigerant across a first heat exchange means, collecting contaminate waste in a sump, and drawing the refrigerant vapors across second heat exchange means include;

conducting said introduced contaminated refrigerant in a first direction across said first heat exchange means for vaporizing said contaminated refrigerant and following vaporization diverting the refrigerant vapors to flow in a second direction across said second heat exchange means while allowing the contaminate waste to continue in said first direction into said sump, thereby separating a substantial amount of contaminants from said refrigerant vapors.

18. The method according to claim 14 wherein said step of conducting said contaminated refrigerant across a first heat exchange means includes conducting said contaminated refrigerant across a plurality of longitudinally spaced tubular coils having baffle elements on an outer surface thereof to cause it to form droplets which pass therethrough to engage succesive longitudinally spaced ones of said coils and baffle elements.

19. The method according to claim 14 wherein said step of drawing the refrigerant vapors across second heat exchange means in said vessel and into the suction inlet of said compressor means includes drawing said refrigerant vapors through a suction accumulator containing coalescing filter material for removing possible liquid droplets from refrigerant vapors and conducting the refrigerant vapors through said coalescing filter material in a first direction and diverting the refrigerant vapors to flow through said coalescing material in a second direction, and conducting accumulated liquid refrigerant droplets in said suction accumulator back into the interior of said vessel for reprocessing.

20. The method according to claim 19 wherein said suction accumulator has a low-pressure vapor outlet and a high-pressure vapor outlet; and said compressor means comprises a vacuum pump and a high-pressure compressor connected together for selective isolated independent operation, said vacuum pump having a suction inlet connected with said low-pressure vapor outlet, and said high-pressure compressor having a suction inlet connected with said high-pressure vapor outlet; and said step of compressing said refrigerant vapors to increase the temperature comprises selectively isolating said high-pressure compressor and conducting said refrigerant vapors into said said vaccum pump, or isolating said vacuum pump and conducting said refrigerant vapors into said high-pressure compressor;

said vacuum pump being selectively placed in use for compressing low-pressure refrigerant vapors, and said high-pressure compressor selectively placed in use for compressing high-pressure refrigerant vapors.

21. The method according to claim 14 comprising the further steps of:

withdrawing a portion of said condensed contaminate waste from said sump;

conducting said withdrawn contaminate waste through heating means to heat said withdrawn contaminate waste; and conducting said heated withdrawn contaminate waste back into said sump after being heated to add additional heat to said said contaminate waste in said sump and facilitate vaporization of residual refrigerant.

22. The method according to claim 14 including the steps of:

connecting said separation vessel in fluid communication with an outlet on the low pressure side of a refrigeration system containing contaminated refrigerant liquid for admitting contaminated refrigerant liquid from said refrigeration system into said vessel; and after the step of filtering said cool liquid refrigerant to remove particulates, acid, moisture, and contaminants therefrom, returning said filtered and purified refrigerant to an inlet on the high pressure side of said refrigeration system from which said contaminated refrigerant liquid was withdrawn.

23. The method according to claim 22 including the step of prior to admitting said contaminated liquid refrigerant from said refrigeration system into said vessel, conducting said contaminated liquid refrigerant from said refrigeration system liquid through heating means to heat said condensed contaminated refrigerant liquid; and thereafter conducting said heated contaminated refrigerant liquid into said vessel for processing.

24. The method according to claim 14 including the further steps of:

heating said filter means to a temperature sufficient to vaporize moisture which has been absorbed in the filter medium;

subjecting said filter means to a vacuum to withdraw the moisture vapors from said filter means; and conducting said moisture vapors into the atmosphere; whereby the combination of heat and vacuum will extract a sufficient amount of moisture from said filter medium to substantially dehydrate and regenerate the filter medium.

* * * * *